United States Patent [19]

Ulrich et al.

[11] Patent Number: 4,537,649

[45] Date of Patent: Aug. 27, 1985

[54] APPARATUS FOR SEALING CARTONS

[75] Inventors: Lawrence W. Ulrich; Connie W. Walker, both of Bolingbrook, Ill.

[73] Assignee: Durable Packaging Corporation, Chicago, Ill.

[21] Appl. No.: 396,885

[22] Filed: Jul. 9, 1982

[51] Int. Cl.[3] ..... B65C 1/04

[52] U.S. Cl. ..... 156/355; 53/137; 156/356; 156/468; 156/486; 156/492; 156/522

[58] Field of Search ..... 156/355, 443, 444, 468, 156/475, 479, 480, 492, 486, 522, 356; 53/137, 374

[56] References Cited

U.S. PATENT DOCUMENTS

| | | | |
|---|---|---|---|
| 2,087,472 | 7/1937 | Dyment | 156/468 |
| 3,461,020 | 8/1969 | Loveland et al. | 156/468 |
| 3,674,606 | 7/1972 | Kinslow | 156/522 |
| 4,039,367 | 8/1977 | Warshaw et al. | 156/492 |
| 4,045,273 | 8/1977 | Loveland | 156/522 |

*Primary Examiner*—Caleb Weston

*Attorney, Agent, or Firm*—Dressler, Goldsmith, Shore, Sutker & Milnamow, Ltd.

[57] ABSTRACT

An apparatus for applying a strip of sealing tape to seal the bottom flaps of a low profile five panel carton comprising a frame structure defining a generally horizontal carton transporting surface; a tape applying means mounted to said fame structure; a bottom trailing tape engaging wipe down means; a directing means mounted to said frame structure for directing a trailing end portion of the strip of tape onto the top surface of the main panel of the carton adjacent the vertical surface of a trailing side panel and a top trailing tape engaging wipe down means mounted to said frame structure.

2 Claims, 6 Drawing Figures

Fig. 1.
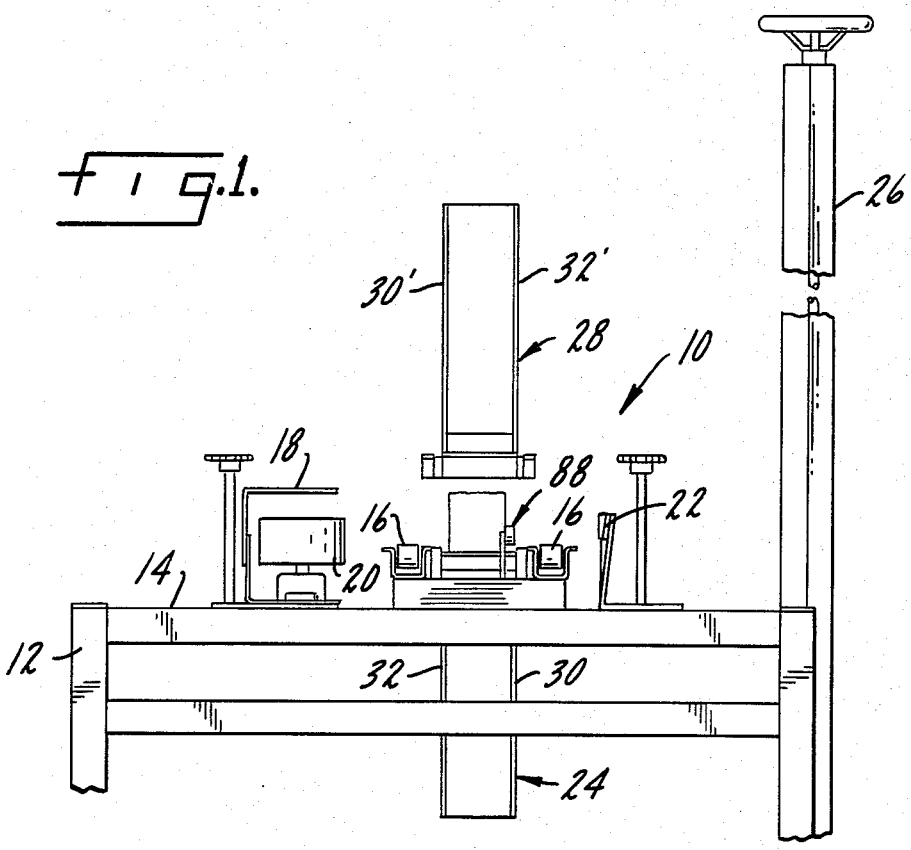
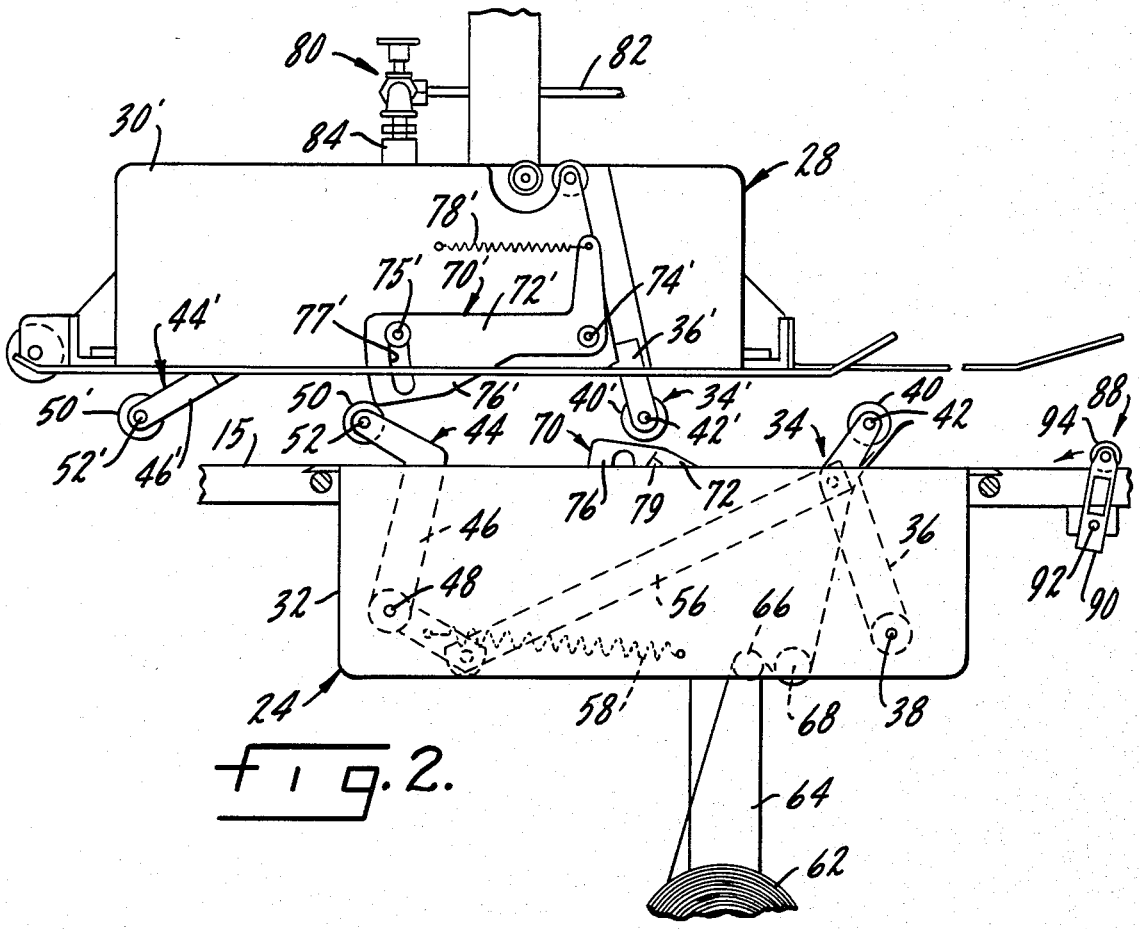
Fig. 2.

APPARATUS FOR SEALING CARTONS

BACKGROUND OF THE INVENTION

The present invention relates to apparatus for the sealing of packaging containers, and more particularly to apparatus for automatically sealing the foldable flaps of low profile cartons of the general type which are used to package books and the like.

In the packaging industry, corrugated and fiberboard cartons have been used for many years and various machines have been developed which are capable of sealing such cartons either by glueing the flaps, taping the flaps or by stapling or otherwise providing mechanical fasteners to maintain the flaps in a closed position. Many of these machines are designed to accept cartons of random width and height by providing various types of sensing means to control the transverse movement of carton centering side arms and the vertical movement of the top sealing means.

The present invention is directed to the type of carton sealing machine which applies a strip of adhesive tape across the flaps of the carton. Examples of such machines are disclosed in U.S. Pat. Nos. 4,044,527, 4,079,577 and 4,173,105, all of which are assigned to the same assignee as the present invention. Although these machines are capable of handling a wide range of different carton sizes, they can not handle cartons which have a very low profile or height dimension. An example of low profile cartons are the cartons which are used to package books. Such cartons, which are known in the industry as five panel cartons, generally have a main panel, upstanding side panels of a short dimension hinged to each of the edges of the main panel, and flaps hinged to the opposed edges of each of the side panels. Due to the small dimension of the side panels it has not been heretofore possible to use general purpose sealing machines to seal such types of low profile cartons.

SUMMARY OF THE INVENTION

It is a primary object of the invention to provide an apparatus for automatically applying a sealing tape across the foldable flaps of low profile cartons.

Another object of the invention is to provide such an apparatus which is also able to apply a sealing tape across the foldable flaps of larger size cartons.

A further object of the invention is to provide such an apparatus which is simple in design and reliable in operation.

Other objects will become apparent from the disclosure of a preferred embodiment which hereinbelow follows.

Briefly stated, the apparatus of the present invention includes a frame structure defining a generally horizontal carton transporting surface. A tape applying means is mounted to the frame structure for applying a strip of adhesive tape across the foldable flaps, up the side panels, and over a portion of the main panel. A bottom leading wipe down means engages a portion of the tape strip which is initially applied to the leading side panel and which extends across the foldable flaps. A bottom trailing wipe down means engages the portion of the tape strip which is applied to the trailing side panel. A top leading wipe down means engages the portion of the tape strip which is applied to the main panel adjacent the leading side panel. A gas jet means supplies a blast of pressurized gas to direct the portion of the tape strip onto the main panel adjacent the trailing side panel. A top trailing wipe down means engages the portion of the tape strip which is directed onto the main panel by the gas jet means. A control means is provided for sensing the trailing edge of the carton to activate two time delays to initiate and terminate the blast of pressurized gas.

DESCRIPTION OF THE DRAWINGS

FIG. 1 is an end elevational view of a portion of the carton sealing machine of the present invention;

FIG. 2 is an enlarged side elevational view, with parts broken away, of the portion of the machine in FIG. 1 that applies the strip of tape to the carton, which shows the construction and relationships of the wipe down assemblies.

DESCRIPTION OF A PREFERRED EMBODIMENT

Figure 3:
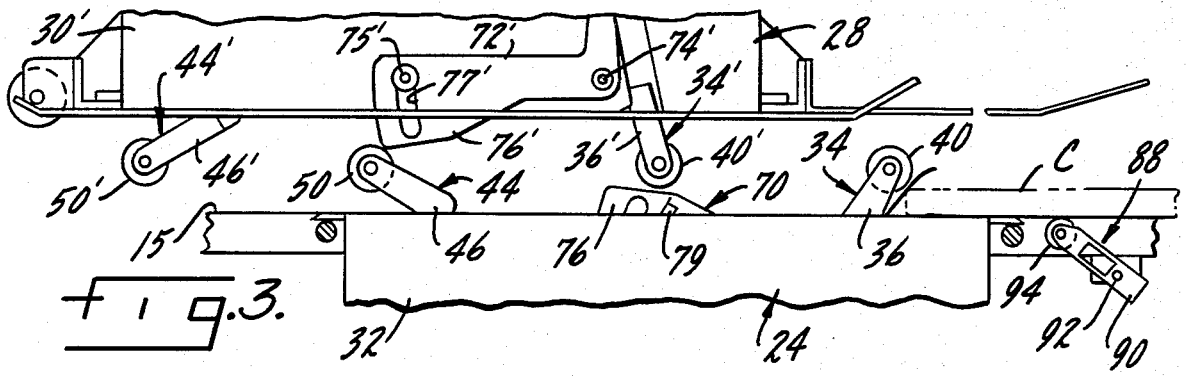
FIGS. 3–6 are diagrammatic views illustrating the sequence of steps during the application and wipe down of the strip of tape on a carton in accordance with the invention.

Referring to FIG. 1, a carton sealing machine constructed in accordance with the invention is indicated generally at 10. Carton sealing machine 10 includes a frame structure 12 which defines a carton transporting surface 14 upon which is mounted a pair of carton conveying roller assemblies 16. A side arm assembly 18 is mounted on frame structure 12. Endless conveyor belt 20 is journalled for rotation around roller members associated with side arm assembly 18. A guide bar assembly 22 is mounted to frame structure 12 in facing relationship to side arm assembly 18. Assemblies 18 and 22 serve to respectively transport and guide the carton through the machine 10 and are preferably mounted to frame structure 12 in a manner which permits transverse sliding movement thereof towards and away from each other, so as to permit machine 10 to accept cartons of varying widths. The invention contemplates the use of a second side arm assembly 18 in place of the guide bar assembly 22. A bottom tape head assembly 24 is mounted to frame structure 12. A vertical lift assembly 26 is mounted to frame structure 12 for support of a top tape head assembly 28, mounted thereto, above the bottom tape head assembly 24. Lift assembly 26 is effective to selectively move the top tape head assembly 28 up and down above the carton transporting surface 14 to accommodate cartons of varying heights. The specific construction and the operation of the tape head assemblies will be hereinbelow discussed in further detail.

Briefly stated, the operation of carton sealing machine 10 is as follows. The elevation of the tape head assembly 28 is adjusted to accommodate the height of the carton and the spacing between the side arm assembly 18 and the guide bar assembly 22 is adjusted to accommodate the width of the carton. The carton is then fed into machine 10 until the belt 20 contacts the side of the carton, whereupon, the belt remains in contact with the carton and moves it past the tape head assemblies. A strip of sealing tape is applied across the flaps, the end panels, and a portion of the main panel. The belt 20 continues to move the carton through the machine for delivery to an outlet conveyor (not shown). The present invention is directed to the specific manner in which the sealing tape is applied to the carton, particularly when such tape is applied to low profile cartons.

The bottom tape head assembly 24 and the top tape head assembly 28 are generally of identical construction, the portions thereof which are pertinent to the understanding of the present invention will now be described. In describing the constrution of assemblies 24 and 28 reference will be made interchangeably between the two assemblies, it being understood that corresponding parts are present in both assemblies, with the corresponding numerals identifying the parts in the top tape head assembly being following by a prime sign.

Referring to FIG. 2, the tape head assemblies 24 and 28 are shown in their inoperative positions. The tape head assemblies includes a pair of spaced apart side plates 30 and 32. Bottom tape head assembly 24 includes a bottom leading tape engaging wipe down assembly 34 which is mounted between the entrance ends of the side plates 30 and 32. Assembly 34 includes a pair of spaced apart arm members 36 which are respectively pivotted to plates 30 and 32 by pin 38. A roller member 40 is journalled for rotation between the upper end portions of arms 36 through pin 42. The upper end portions of arms 36 extend above the surface 14 and are preferably bent towards the entrance end of the machine 10. Top tape head assembly 28 similarly includes a top leading wipe down assembly 34'. A bottom trailing tape engaging wipe down assembly 44 is mounted between the exit ends of the side plates 30 and 32. Assembly 44 includes a pair of spaced apart arm members 46 which are respectively pivoted to plates 30 and 32 by pin 48. A roller member 50 is journalled for rotation between the upper end portions of arms 46 through pin 52. The upper end portions of arms 46 extend above the surface 14 and are preferably bent towards the exit end of the machine 10. Top tape head assembly 28 similarly includes a top trailing wipe down assembly 44'. Assemblies 34 and 44 are connected together through a pivot link member 56, such that the movement of assembly 34 is translated to movement of assembly 46 in a manner which will be hereinbelow further discussed. A spring member 58 extends between link member 46 and side plate 32 to bias the assemblies 34 and 44 towards their outer positions, as shown in FIGS. 2 and 3.

Figure 5:
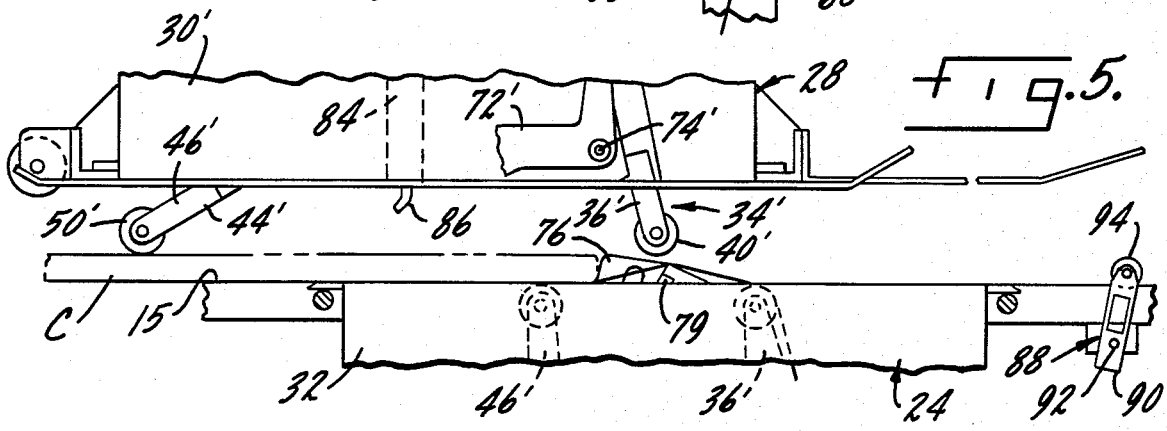

A roll of adhesive sealing tape 62 is supported on a spool (not shown) attached to a plate 64. The end of the tape is threaded around rollers 66 and 68 and extends upward above the surface 14 immediately forward of assembly 34. A tape cut-off assembly 70 is secured to side plate 30 to sense the trailing edge of the carton and cut the strip of tape. Although assembly 70 is best shown in conjunction with the top tape head assembly 28, the operation of the invention does not make use of this assembly, and it may therefore be eliminated. However, for the purpose of describing assembly 70, reference will be made to the showing associated with the assembly 28. Assembly 70 includes a plate member 72 which is pivotally mounted to side plate 30 by a pivot pin 74 and a guide pin 75, which extends into slot 77. Plate member 72 includes a portion 76 which is biased to extend above surface 14 by spring 78. Referring to FIG. 5, cutting blade 79 is suitably secured to plate 72 to cut the end of the tape as the trailing edge of the carton terminates contact with the plate 72, the operation of which will be hereinbelow further described.

Top tape sealing head assembly 28 is supported above the bottom tape sealing head assembly 24. As seen in FIGS. 2–6, the assembly 28 is positioned rearwardly of assembly 24 such that the top leading wipe down assembly 34' is positioned approximately midway between the bottom wipe down assemblies 34 and 44 and the top trailing wipe down assembly 44' is positioned rearwardly of the bottom trailing wipe down assembly 44. The construction of machine 10 as so far disclosed hereinabove is known in the art and is presently commercially available for use in the sealing of conventional cartons. However, such a machine is not able to seal the bottom flaps of low profile five panel cartons whose heights are generally $2\frac{1}{2}$ inches or less. When such a carton is passed through the machine, the trailing end of the tape will not be wiped down onto the main or top panel of the carton by the top trailing wipe down assembly 44'.

In accordance with the present invention, a means is provided to direct the trailing end of the tape onto the main panel of the carton prior to its passage under the top trailing wipe down assembly 44'. Referring to FIGS. 2 and 5, a gas jet assembly 80 is mounted to the top tape head assembly 28. A gas line 82 supplies pressurized gas to assembly 80. Assembly 80 includes a conduit 84 which extends downward between plates 30 and 32. A nozzle 86 is provided in communication with conduit 84 to direct the pressurized gas onto the trailing end of the strip of tape.

Figure 4:
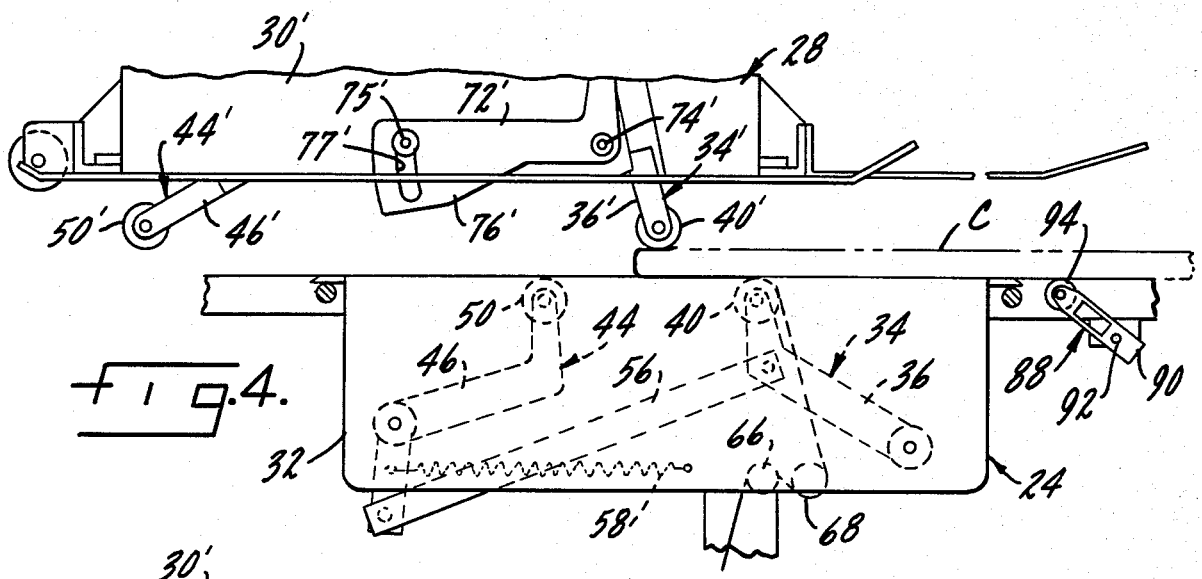
Figure 6:
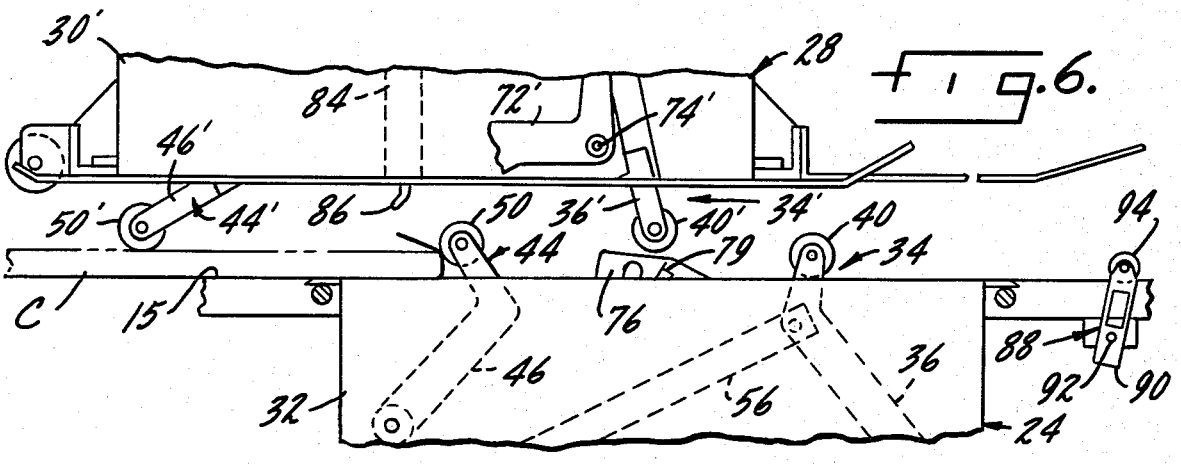

The flow of gas through assembly 80 is controlled by a switch assembly 88. Assembly 88 included a switch member 90 which is pivotally mounted to frame structure 12 at pivot pin 92. The upper end of member 90 extends above surface 14 and has a roller member 94 associated therewith. Member 92 is pivotable between a first position, as shown in FIGS. 2, 5 and 6, and a second position, as shown in FIGS. 3 and 4. Suitable means is provided to bias member 92 towards its first position. The function and operation of switch assembly 88 will be described in conjunction with the description of the operation of machine 10 which immediately hereinbelow follows.

Referring to FIGS. 3–6, the operation of machine 10 will now be discussed in conjunction with the sealing of a low profile five panel carton, indicated generally at C. Although not specifically shown, carton C is of a rectangular form having a main panel, upstanding side panels of a short dimension hinged to each of the sides of the main panel, and flaps hinged to the opposed edges of each of the side panels. After the carton blank is filled, the side panels are folded up and flaps are infolded to close the carton. The carton is then fed into machine 10 in an orientation with the main panel at the top and the infolded flaps at the bottom, preferably with the seam between the lowermost flaps parallel to the longitudinal axis of the machine. At this point, the machine 10 and carton C are as shown in FIG. 3. It will be noted that the top tape head assembly 28 is positioned a short distance above the bottom tape head assembly 24 and the leading end of the tape extends upward in front of assembly 34.

As the carton C enters the machine 10 it pushes down switch member 90 to its second position, which activates a series of pneumatic valves (not shown), the purpose of which will hereinbelow become more apparent. As the carton is advanced through machine 10 by the side arm assembly 18 in a well known manner, the leading side panel contacts the gummed side of the tape, which is applied thereto by its contact with the roller 40 of assembly 34 as the carton C continues to advance through the machine. It should be noted that the leading end of the tape extends over the top leading edge of the carton C.

As seen in FIG. 4, as the carton continues to advance the assemblies 34 and 44 are pivotted downwardly such that the upper surfaces of the rollers 40 and 50 are at the level of the flaps of Carton C. The tape is pulled from the roll 62 and applied across the seam between the flaps by the upward pressure of the rollers 40 and 50 and applied thereagainst as the carton C moves therepast. Simultaneously, the roller 40′ of assembly 34′ wipes down the leading end of the tape over the main panel as the leading edge of carton C moves therepast. As the carton C moves over assembly 70, the member 72 is pivotted downwardly below the level of the carton C against the bias of spring 78.

As the trailing edge of the carton C passes over the switch member 90 it is returned to its upright or first position which is effective to activate a pair of time delays. The first time delay serves to initiate the passage of pressurized gas through assembly 80 immediately prior to the passage of the leading edge of carton C under the nozzle 86. The second time delay serves to terminate the passage of pressurized gas through assembly 80 after a predetermined period of time. The specific pneumatic circuitry is not deemed to be a significant aspect of the invention and, as will be apparent to one skilled in the art, various pneumatic delay circuits may be utilized to achieve the time delays disclosed above.

Referring to FIG. 5, as the trailing edge of carton C advances over assembly 70, the member 72 is rapidly moved into its second position which causes the knife edge 79 to cut the trailing end of the tape. A short trailing end portion of the tape is left trailing the carton C. Referring to FIG. 6, as the trailing edge of the carton C passes over assembly 44, the assemblies 34 and 44 are pivotted upwardly and outwardly such that the roller 50 contacts and wipes a portion of the trailing end portion of the tape onto the trailing side panel. A momentary time thereafter the first time delay activates the passage of a blast of pressurized gas through the nozzle 86, which blows down the trailing end of the tape onto the main panel. A short time thereafter, the second time delay terminates the passage of gas through the assembly 80. Although not specifically shown, as the carton exits the machine 10 the roller 50′ of assembly 44′ wipes down the trailing end of the tape onto the main panel.

The machine 10 as hereinabove disclosed may be used to seal both convention cartons and low profile five panel cartons. When used to seal conventional cartons the assembly 80 is inactivated and the machine operates in a conventional mode. In such instances where the machine 10 is only to be utilized to seal low profile cartons, it is not necessary that the assembly 28 include all of the structure of a tape head assembly. For example, the present invention contemplates the use of a top leading tape wipe down means and a top trailing tape wipe down means, which may be secured in place above the transport surface 14. There is no need for the sections which feed the tape and cut off the tape. However, by utilizing a top tape head assembly as disclosed, the machine's versatility is increased.

The foregoing is a description of a preferred embodiment of the invention which is given here by way of example. The invention is not to be taken as limited to any specific features as described, but comprehends all such variations thereof as come within the scope of the appended claims.

I claim:

1. In an apparatus for applying a strip of sealing tape to seal the bottom flaps of a low profile five panel carton; said carton having a main panel, upstanding side panels of a short dimension hinged to each of the edges of the main panel, and bottom flaps hinged to the opposed edges of each of the side panels; said apparatus comprising: a frame structure defining a generally horizontal carton transporting surface; a tape applying means mounted to said frame structure generally below said transporting surface, said tape applying means includes a bottom leading tape engaging wipe down means for engaging the portion of the strip of tape which is initially applied to a vertical surface of the leading side panel of the carton and which extends across the bottom flaps of the carton; a bottom trailing tape engaging wipe down means for engaging the portion of the strip of tape applied to the vertical surface of the trailing side panel of the carton; a top leading tape engaging wipe down means mounted to said frame structure above said transporting surface for engaging a leading end portion of the strip of tape applied to the top surface of the main panel of the carton adjacent said vertical surface of the leading side panel; a directing means mounted to said frame structure for directing a trailing end portion of the strip of tape onto the top surface of the main panel of the carton adjacent said vertical surface of the trailing side panel, said directing means includes a gas jet means for supplying a blast of pressurized gas onto the trailing end portion of the strip of tape; a control means for sensing the trailing edge of the carton and initiating the blast of pressurized gas and terminating the blast of pressurized gas; and a top trailing tape engaging wipe down means mounted to said frame structure above said transporting surface for engaging said trailing end portion of the strip of tape directed onto said top surface of the main panel of the carton by said directing means.

2. The invention as defined in claim 1 wherein said control means has first and second time delays, said first time delay being such as to initiate the blast of pressurized gas after a predetermined amount of time has lapsed after sensing said trailing edge and said second time delay being such as to terminate the blast of pressurized gas after a predetermined amount of time has lapsed after sensing said trailing edge.

* * * * *